United States Patent [19]

Vandenbussche

[11] Patent Number: 4,538,766

[45] Date of Patent: Sep. 3, 1985

[54] PROCESS AND APPARATUS FOR CRUSHING RAW MATERIALS

[75] Inventor: Joseph Vandenbussche, Roeselare, Belgium

[73] Assignee: Constructie Werkhuizen Vandekerckhove N.V., Roeselare, Belgium

[21] Appl. No.: 500,848

[22] Filed: Jun. 3, 1983

[51] Int. Cl.[3] ..... B02C 18/18

[52] U.S. Cl. ..... 241/30; 241/236; 241/243

[58] Field of Search ..... 241/24, 30, 236, 243, 241/282.1, 282.2, 292.1, 293, 294, 295, 159

[56] References Cited

U.S. PATENT DOCUMENTS

| | | | |
|---|---|---|---|
| 252,128 | 1/1882 | Morts | 241/243 X |
| 3,703,970 | 11/1972 | Benson | 241/243 X |
| 3,860,180 | 1/1975 | Goldhammer | 241/236 X |
| 3,991,944 | 11/1976 | Baikoff | 241/243 X |
| 4,077,573 | 3/1978 | Kersey et al. | 241/243 X |
| 4,394,983 | 7/1983 | Ulsky | 241/243 |

FOREIGN PATENT DOCUMENTS

| | | | |
|---|---|---|---|
| 686692 | 5/1964 | Canada | 241/243 |
| 2702177 | 7/1978 | Fed. Rep. of Germany | 241/159 |

*Primary Examiner*—Mark Rosenbaum

*Attorney, Agent, or Firm*—Shlesinger, Arkwright, Garvey & Fado

[57] ABSTRACT

A process for reduced energy consumption while comminuting waste materials includes delivering the materials to a comminuting chamber having a longitudinally extending comminuting zone. A plurality of actuable series of comminuting units are provided and are operable in said chamber. The comminuting units are arranged in series and are successively staggered in an inclined relation adjacent the comminuting zone. Each of the series is successively staggered one behind the other so that the last unit of the first series is positioned for impaction before the first unit of the next succeeding series. The units of the second series are interdigitated for impaction between the units of the first series. The series are successively actuated so that the comminuting units impact certain areas of the waste material by causing the series to successively impact the material so as to avoid simultaneous impaction of immediately adjacent areas of the material.

20 Claims, 6 Drawing Figures

FIG. 1
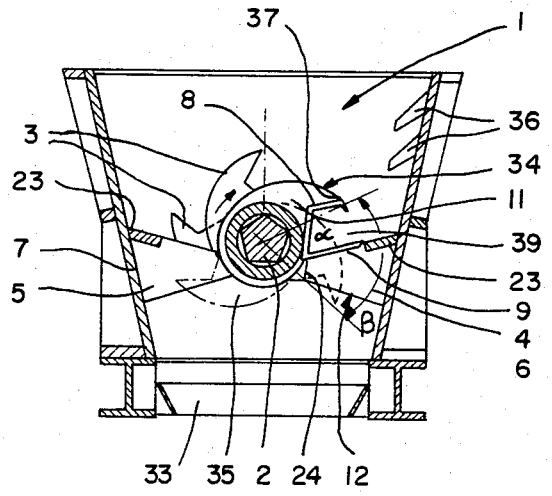
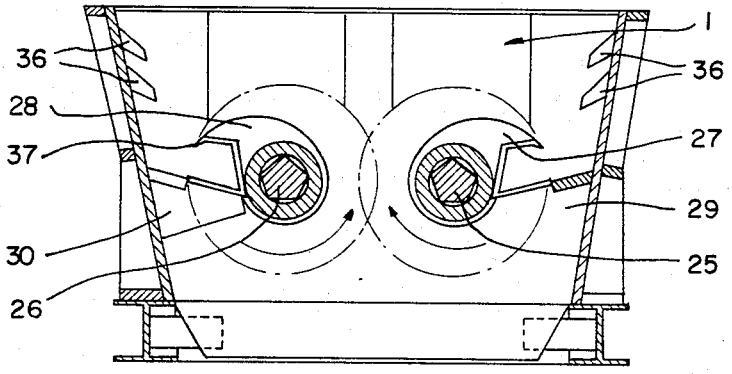
FIG. 3

14
13
0 1 2 3 4 5 6 7 8 9 10 11 12 1
1 2 3 4 5 6 7 8 9 10 11 12

16
15
17
0 1 2 3 4 5 6 7 8 9 10 11 12 13 14 15 1
1 2 3 4 5 6 7 8 9 10 11 12 13 14 15

20
21
18
19
0 1 2 3 4 5 6 7 8 9 10 11 12 13 14 1
1 2 3 4 5 6 7 8 9 10 11 12 13 14

PROCESS AND APPARATUS FOR CRUSHING RAW MATERIALS

The invention relates to a process and apparatus for crushing raw materials such as waste materials particularly offal, animal carcasses, bones, entrails etc.

BACKGROUND OF THE INVENTION

This crushing process is generally a first step in the recovery process of fats and other by-products form offal and use is thereby made of conventional offal crushers comprising a comminuting chamber in which a rotatable shaft is arranged bearing a set of side by side arranged knifes which pass through calibrated slots between stationary elements thereby shredding the raw material fed into the chamber. Up to now the knifes were arranged on said shaft so that an imaginary line connecting the consecutive knife-tops from one end of the shaft towards the other is a helicoid or almost a helicoid. A disadvantage of this kind of arrangement of the knives relates to the relatively high energy consumption for a certain output of the crusher. This is mainly due to the fact that the consecutive cutting positions of the knifes regularly shift from one end of the crusher to the other. Each next cutting position is thus very close to the previous one and so each next knife generally hinders a deep penetration of the previous knife top in the material to be crushed. This has as a consequence that the knives on each cutting action only tear relatively small pieces away of the material and that the material (certainly when it is in the form of pieces or lumps with large volumes) continues to tumble on top of the knife cams and thereby builds a sort of a bridge above the rotating knives between the side walls of the chamber. This decreases the output of the crusher.

BRIEF DESCRIPTION OF THE INVENTION

The invention now avoids this drawback by providing a crushing process whereby the consecutive cutting positions of said knives between the stationary elements are distributed over the comminuting chamber so as to achieve on the average a large distance between each two consecutive cutting positions and preferably the largest possible average distance. The shortest distance between any of said two consecutive cutting positions is thereby at least equal to the sum of the width of three stationary elements and the width of the two slots interposed between said three elements.

The invention also provides a crushing apparatus suitable for a crushing operation as described above and bearing at least seven side by side arranged knives on a rotatable shaft in a comminuting chamber.

BRIEF DESCRIPTION OF THE DRAWINGS

Further details, features and advantages of the invention will now be clarified with reference to the accompanying drawings, in which FIG. 1 relates to a vertical cross-section view of the comminucating chamber bearing one rotatable shaft with crushing knives;

FIG. 3 represents a cross section view of a similar crusher with two adjacent knife-bearing shafts in counter rotation;

Figure 2:
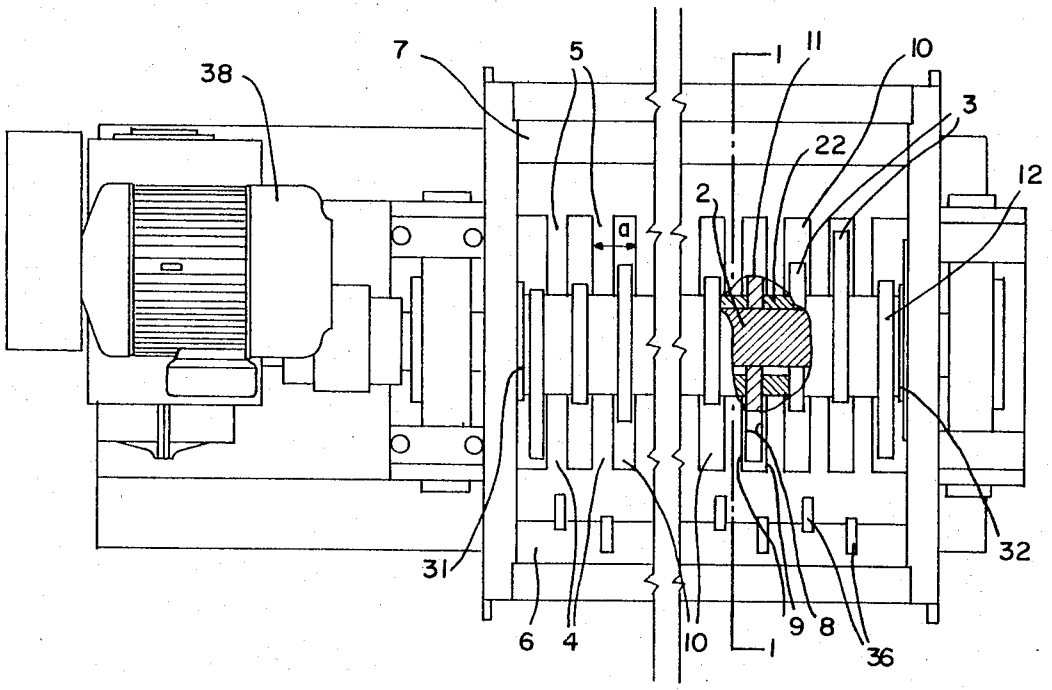
FIG. 2 is a top plan view of the crusher according to FIG. 1.

According to FIG. 1, the comminuting chamber 1 is provided with a horizontal shaft 2 having preferably a polygonal cross-section and supported for rotation in both opposite end walls of the crusher. The shaft 2 bears a set of side by side arranged knives 3 which are rotatable in a vertical plane. The knives or comminuting units 3 pass through calibrated slots provided in adjacent stationary elements 4 resp. 5. Stationary elements 4 and 5 extend substantially the length of chamber 1. The stationary element 4 and 5 each extend from one of the sidewalls 6 and 7. The shaft 2 is disposed between stationary elements 4 and 5. The side by side arranged knives 3 have a different angular orientation one from the other on the shaft thereby provide consecutive cutting positions when passing through the slots in the stationary elements 4 and 5 in a downward direction. According to an important feature of the invention, these consecutive cutting positions of the knives are distributed over the length of the chamber 1 so as to achieve, on the average, a large distance between each two consecutive cutting positions, which average distance is preferably as large as possible.

In FIG. 2 an example is shown of these consecutive cutting positions at the edges 8 of knives 3 and the cooperating edges 9 of slots 10 between adjacent stationary elements 4. The shortest distance between any of said two consecutive cutting positions, e.g. between knife 12 and 11, is thereby at least equal to the sum of the width of three stationary elements (4) and the width of the two interposed slots.

Figure 4:
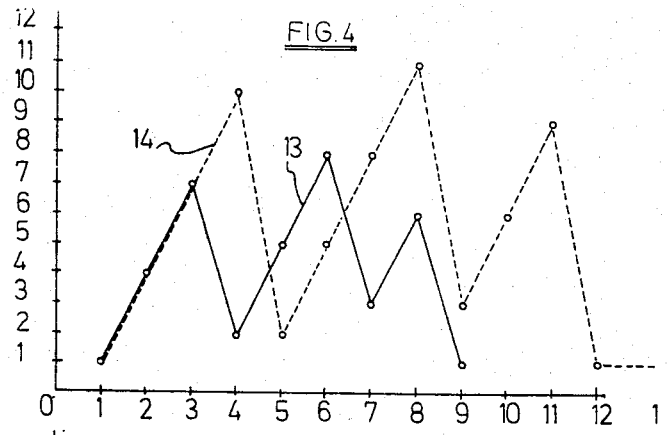
FIG. 4 is a graph representing possible relationships between the order of the knives over the length of the shaft (ordinat) and the consecutive order of the cutting positions (abcis) of the knives for a crusher with 8, resp. 11 knives on the shaft.
Figure 5:
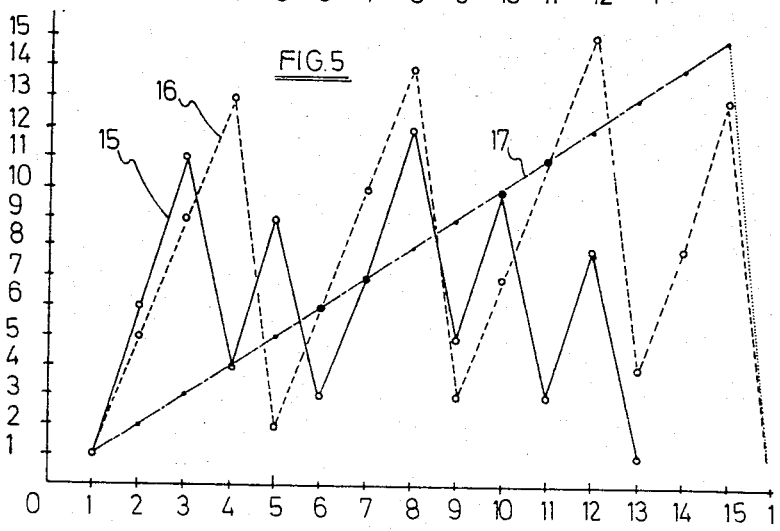
FIG. 5 is a similar graph for a crusher with 12, resp. 15 knives.
Figure 6:
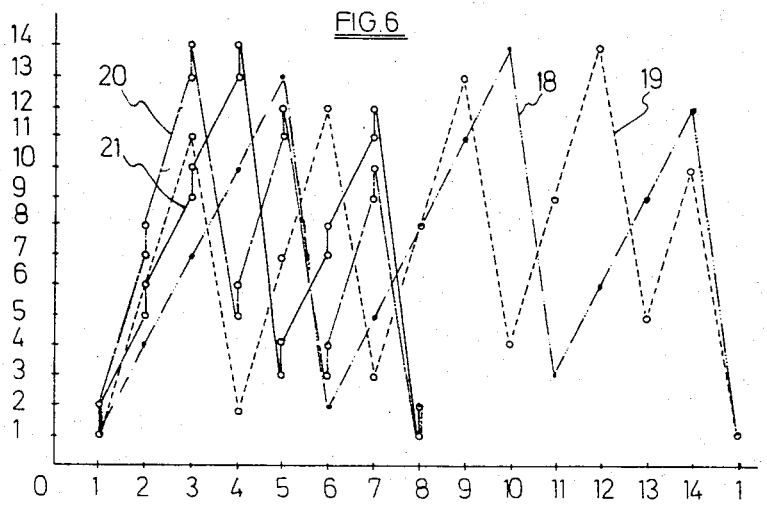
FIG. 6 is a similar graph for different possibilities for a crusher with 14 knives.

Some exemplary embodiments of possible relationships between the order of the knives on the length of the shaft (counted continuously from one end 31 to the other end 32) and the consecutive order of the cutting positions of said knives (counted in the same manner) are shown in FIGS. 4, 5 and 6.

The line 13 in FIG. 4 for a crusher with eight knifes on the shaft and shows a first cutting position for knife number one (next to the end 31 of the shaft). The second cutting position is situated at knife number four (counted from the same end 31 of the shaft), the third at knife number 7, the fourth at knife number 2 etc. So between any two consecutive cutting positions at least three stationary elements 4 are present. The average distance is thus here $$\frac{(5 \times 3) + (3 \times 5)}{8} = 3.75$$

times the width of one stationary element (plus of course 2.75 times the width of one intermediate slot. The angle $\beta$ formed between the radial directions of each two knives on the shaft having consecutive cutting positions is thereby 360°: 8=45°.

Similarly, the line 14 in FIG. 4 shows a distribution of cutting positions for a crusher with eleven knives. The average distance is here larger. The line 15 in FIG. 5 represents a distribution for a crusher with 12 knives; the average distance is here still larger. According to the line 16 in FIG. 5 for a crusher with fifteen knives, the average distance amounts already to 5.86 times the width of one element plus 4.86 times the width of one slot. The angle $\beta$ is here 360°: 15=24°. With a conventional crusher, where the order of the consecutive cutting positions would correspond to the order of the knives, the distribution of said positions would meet line 17 in FIG. 5. The average distance would only reach 1.93 times the width of one stationary element plus 0.93 times the width of one slot.

In general, different distribution models for the cutting positions can be used for the same number of knives in the crusher. The graph of FIG. 6 illustrates such a case for a crusher with 14 knives. Where every cutting position comprises only one knife with the surrounding slot matching the knife edge, a distribution model as represented by line 18 or 19 is applicable. The average distance of the distribution according to line 19 is larger and thus generally will be preferred. However it is also possible to choose at least a part of the cutting positions each comprising two (or even more) adjacent knifes as suggested by lines 20 resp. 21 in FIG. 6. The average distance according to the distribution of line 19 is the most elevated followed by the distribution according to line 20. The average distance of the distribution meeting line 18 is the lowest and will thus generally not be preferred.

It can be seen therefore from FIGS. 4–6 that at least two series of knives 16 are arranged about the shaft 2. Each of the series includes a plurality of knives 16. For example, a total of eight knives 16 are arrayed in three series about the shaft 2, as shown by curve 13 of FIG. 4. The first series is comprised of knives 16 arrayed at cutting positions 1, 4 and 7. The second series includes knives arrayed at cutting positions 2, 5 and 8. Finally, the third series includes knives which are arrayed at cutting positions 3 and 6. It can be seen, therefore, that the first two series each includes three knives 16 and the third series includes two knives 16. The first knife two of the second series is, therefore, disposed between the first and second knives of the first series and is disposed longitudinally adjacent the first knife one of the preceding series. Similarly, the first knife three of the third series is disposed between knives two and five of the second series and is likewise longitudinally disposed adjacent the first knife of the second series. It can be seen, therefore, that each of the knives of a series is interdigitated for impaction between the knives of the preceding series and that each of the knives of the subsequent series is longitudinally disposed adjacent a corresponding knife of the preceding series.

When we now consider a case where the width of the stationary elements are equal to each other and to the width of each slot and when we give this width the value one, then it has been found that for such a case, the ratio of the average distance between each two consecutive cutting positions to the number of knifes should preferably be greater than 0.7 for crushers with less than 16 knives. For crushers with 16 knives and more, this ratio should preferably be at least 0.9.

The apparatus according to the invention offers still a number of other advantageous features. Between the side by side arranged knives, ring like spacer members 22 are provided with the desired thickness corresponding (approximately) to the width of the stationary elements. These members 22 are preferably fixed to the adjacent knifes and they have an axial bore concentric with the shaft 2. By fixing the knives 3 and members 22 to each other, e.g. by welding, they form a solid assembly which can be slid onto the shaft. The cross-section of the central bore in the knives 3 and optionally also in the spacer members 22 is thereby designed so as to match or to meet the polygonal periphery of the shaft 2 at least in part. This shaft cross-section can in practice be triangular, square, pentagonal or hexagonal. By thus assembling and combining the knives and members 22 into one solid body, the torsional moment created by the action of rotatively driving the shaft by motor 38 and reaction by the resistance of the material to be shredded between the knife edges 8 and slot edges 9 is spread over the whole length of the shaft and is thus not limited to the area of the consecutive cutting positions.

Further, in order to improve the cutting efficiency it is desirable that during the entire cutting action, at least a portion of the cutting edges 8 of the knifes present an angle $\alpha$ of at least 10° with the cooperating slot edges 9. Such an arrangement is shown in FIGS. 1 and 3 where said angle is even more than 20°. Additionally it is recommended that the slot edges 9 extend with a slope from a higher level 23 against the chamber side walls 6 resp. 7 to a lower level 24 against the periphery of a spacer member 22 and situated below the rotating axis of the knives 3. Due to this configuration or design the material is always inclined to slide downwards from the wall 6 into the crushing area 39. At the same time the shape and orientation of the knife edges 8 push the material back upwards, away from the shaft and urge it in a downward direction into the slots thereby efficiently cutting it by a shearing operation at the intersecting position between said edges 8 and 9. When the knife then continues its rotation, the shredded pieces of material fall down into the lower part 33 of the crushing chamber e.g. in a channel like space (not shown) known in itself and from where it can e.g. axially be removed by conventional means such as a conveyor screw or belt. The knives rotate further in upward direction between the stationary elements 5. The knife edges 8 and knife cams 34 are thereby cleaned of any material pieces which may remain or stick on them pursuant to the cutting action. It is possible in some cases to arrange more than one knife on the shaft in the same plane and thus cutting through the same slot. Such a knife 35 is shown in dotted lines on FIG. 1.

In the embodiment illustrated in FIG. 3 the chamber 1 includes two parallel shafts 25 and 26 whereby the knives 27 on the shaft 25 interleave with the knives 28 on the shaft 26. The rotational direction of shaft 26 is opposite to that of shaft 25 and the knives pass in downward direction through the slots between the stationary members 29 resp. 30 which are arranged against both opposite side walls of the chamber. This embodiment is designed for crushing e.g. very large lumps of materials. The design of the knives and the relationship between order of the knives on the shafts and their respective cutting order upon rotation of the shafts is similar to that described above. To prevent a tumbling action of the material on the cams of the knifes, barblike elements 36 can be fixed on the side walls.

Having thus described the main features, it is evident that constructional modifications are possible in view of the intended use of the crusher. So the shape of the knife cams 34 and knife edges 8, the slope of the stationary elements 4, 5 and of the side walls 6, 7 can be adapted to specific applications (e.g. for crushing rubbery articles such as used tires). The knife edges 8 and slot edges 9 consist of course of hardened steel material to resist wear by the cutting action. The knife tops will prefera-bly be provided with a sharp hook like edge 37 to improve the penetration performance in the material.

EXAMPLE

A conventional crusher with a helicoidal arrangement of fifteen side by side knifes on the shaft was compared with an identical crusher wherein a distribution of consecutive cutting positions was achieved as described hereinbefore and shown in the line 16 of FIG. 5. Similar carcass bodies (same weight) of cattle were introduced in the crushing chamber. The output of the crusher according to the invention was 10% lower than that for the conventional crusher but with a reduction of energy consumption of the electrical driving engines 38 of about 25% than that for the conventional crusher.

I claim:

1. An energy saving comminuter for waste materials, particularly offal, animal carcasses and the like, comprising:

(a) a pair of end walls and a pair of spaced apart sidewalls extending therebetween defining a longitudinally extending comminuting zone;

(b) actuation means operably associated with at least one of said walls;

(c) at least three actuable series of comminuting units operably associated with said actuation means and actuable thereby into and out of said comminuting zone; and, (d) the comminuting units of each of said series disposed in a successively staggered inclined relation adjacent said comminuting zone and each of said series successively disposed behind a first of said at least three series so that the last unit of the first of said series is positioned for impaction in said comminuting zone before the first unit of the next succeeding series and the units of any series are interdigitated between the units of any other series so that successive actuation of each of said at least three series by said actuation means causes the units of each of said series to impact certain areas of waste material disposed in said comminuting zone and to successively impact the waste material and to thereby avoid simultaneous impaction of immediately adjacent areas of the waste material.

2. The comminuter as defined in claim 1, wherein:

(a) each of said comminuting units includes at least one knife.

3. The comminuter as defined in claim 1, wherein:

(a) said actuation means includes a rotatable shaft disposed between said sidewalls and extending between said end walls.

4. The comminuter as defined in claim 3, wherein:

(a) each of said comminuting units includes at least a first knife;

(b) each of said knives mounted to said shaft and rotatable therewith; and, (c) spacer means associated with said shaft and with each of said knives for maintaining longitudinal positioning of said knives on said shaft.

5. The comminuter as defined in claim 4, wherein:

(a) a plurality of spacer means are provided and each of said spacer means is secured to an associated one of said knives.

6. The comminuter as defined in claim 5, wherein:

(a) said shaft has a periphery of polygonal shape; and, (b) each of said knives and said spacer means has a contoured aperture for receiving therein said shaft.

7. The comminuter as defined in claim 6, wherein:

(a) each of said spacer means is secured to the adjacent knives for thereby providing a solid assembly.

8. The comminuter as defined in claim 3, wherein:

(a) a second shaft is rotatably mounted to said endwalls and extends therebetween and is spaced from and parallel to said first mentioned shaft;

(b) a plurality of longitudinally spaced comminuting units are mounted to said second shaft and rotatable therewith and said comminuting units of said second shaft are disposed in a plurality of series successively staggered in an inclined relation adjacent said comminuting zone and each of said series successively disposed behind a first of said plurality of series so that the last comminuting unit of the first of said series is positioned for impaction in said comminuting zone before the first unit of the next succeeding series and the units of a second of said series are interdigitated between the units of said first series and said units of said second shaft are longitudinally spaced thereon and thereby interdigitated between the units of said first mentioned shaft; and, (c) means associated with said second shaft for rotating said second shaft in a direction opposite to the direction of rotation of said first mentioned shaft.

9. The comminuter as defined in claim 3, wherein:

(a) at least one of said units includes a plurality of cutting elements adapted for rotating in parallel planes.

10. The comminuter as defined in claim 3, wherein:

(a) a stationary member is secured to each of said sidewalls and substantially spans the length thereof;

(b) each of said members includes a plurality of longitudinally spaced stationary elements extending generally towards said shaft and each of said stationary elements separated from adjacent stationary elements by a calibrated slot; and, (c) each of said comminuting units aligned with one of said slots and movable therethrough whereby passage of a comminuting unit through its associated slot causes comminuting of the waste material.

11. A process for reducing energy consumption when comminuting waste materials and the like which includes the steps of:

(a) delivering said materials to a comminuting chamber having a longitudinally extending comminuting zone;

(b) positioning said material along said zone;

(c) providing at least three actuable series of comminuting units in said chamber;

(d) arranging each of said comminuting units of each of said series in a successively staggered inclined relation adjacent said comminuting zone;

(e) arranging each of said series successively behind a first series of said plurality of series so that the last unit of the first of said series is positioned for impaction before the first unit of the next succeeding series;

(f) displacing the second series of said plurality of series so that each unit of said second series is interdigitated for impaction between the units of said first series and between the units of any subsequent series and so that each of said units of any series is interdigitated between the units of any other ones of said series;

(g) sequentially actuating said plurality of series of comminuting units in said comminuting zone;

(h) impacting certain areas of said waste material by causing said at least three series to successively impact said waste material so to avoid simultaneous impaction of immediately adjacent areas of said material; and, (i) removing said material from said chamber by said successive impaction.

12. A process for comminuting waste materials, particularly offal, animal carcasses and the like, in a comminuting chamber having rotation means supporting a plurality of cutting means and wherein said cutting means cooperate with a means for providing a plurality of cutting positions, comprising the steps of:

(a) providing at least three successive series of cutting means with each of said series including a plurality of cutting means and each of said cutting means including at least one knife;

(b) successively staggering said successive series on said rotation means one behind the other along a diagonal line and with each series having its diagonal line extending diagonally in the same direction as the other series so that the first cutting means of each series follows the last cutting means of the previous series so that a plurality of the knives of a subsequent series are interdigitated between the knives of any other series;

(c) providing a supply of waste material; and, (d) rotating said rotation means and thereby causing the cutting means of said successive series to serially cooperate with said means for thereby comminuting said waste material by impacting certain areas of said waste material and causing said plurality of series to successively impact said material so to avoid simultaneous impaction of immediately adjacent areas of said material.

13. An energy saving comminuter for comminuting waste material, particularly offal, animal carcasses and the like, comprising:

(a) a pair of end walls and a pair of spaced apart sidewalls extending therebetween defining a longitudinally extending comminuting zone;

(b) a shaft rotatably mounted to one of said endwalls and extending between said endwalls;

(c) a first and a second member, each of said members secured to one of said sidewalls and substantially spanning the length thereof and each of said members includes a plurality of longitudinally spaced stationary elements extending generally towards said shaft and each of said stationary elements separated from adjacent stationary elements by a calibrated slot;

(d) said slots and said stationary elements of one of said members aligned with the slots and stationary elements of the other of said members for thereby providing cooperating pairs of slots;

(e) at least seven longitudinally spaced knives mounted to said shaft and rotatable therewith in a plane generally transverse to the axis of said shaft and each of said knives aligned with one slot of at least one of said members so that the passage of a knife through its aligned slot provides a cutting position for comminuting the waste material;

(f) said knives disposed in at least three actuable series of knives with each of said series including a plurality of knives and each knife of a series actuable into and out of said comminuting zone;

(g) the knives of each of said series disposed in a successively staggered inclined relation adjacent said comminuting zone and each of said series successively disposed behind a first of said at least three series so that the last knife of the first of said series is positioned for impaction in said comminuting zone before the first knife of the next succeeding series and the knives of each series are interdigitated between the knives of any other series so that successive actuation of each of said at least three series by said shaft causes the knives of each of said series to impact certain areas of waste material disposed in said comminuting zone and to successively impact the waste material and to thereby avoid simultaneous impaction of immediately ajdacent areas of the waste material; and, (h) means for rotating said shaft and thereby actuating said series.

14. The comminuter as defined in clain 13, wherein:

(a) spacer means associated with said shaft for maintaining longitudinal positioning of said knives.

15. The comminuter as defined in claim 14, wherein:

(a) a plurality of spacer means are provided and each of said spacer means is associated with one of said knives; and, (b) each of said spacer means is secured to the associated knife.

16. The comminuter as defined in claim 15, wherein:

(a) said shaft has a periphery of polygonal shape; and, (b) each of said knives and said spacer means has a contoured aperture adapted for receiving therein said shaft.

17. The comminuter as defined in claim 16, wherein:

(a) each of said spacer means is secured to the adjacent knives for thereby providing a solid assembly.

18. The comminuter as defined in claim 12, wherein:

(a) said members are secured to said sidewalls above said shaft and said stationary elements extend to a terminal portion disposed below said shaft for thereby providing sloped surface adapted for directing waste material towards said slots.

19. The comminuter as defined in claim 13, wherein:

(a) a second shaft is rotatably mounted to said endwalls and extends therebetween and is spaced from and parallel to said shaft;

(b) at least seven longitudinally spaced knives are mounted to said second shaft and rotatable therewith and are interdigitated between the knives of said first mentioned shaft; and, (c) means are associated with said second shaft for rotating said second shaft in a direction opposite to the direction in which said first mentioned shaft is rotated.

20. The comminuter as defined in claim 12, wherein:

(a) at least one of said knives includes a plurality of cutting elements adapted for rotating in a common plane and each of said cutting elements aligned with a common slot.

* * * * *